US009916924B2

(12) United States Patent
Dong et al.

(10) Patent No.: US 9,916,924 B2
(45) Date of Patent: Mar. 13, 2018

(54) CENTER-TAPPED TRANSFORMER

(71) Applicant: Delta Electronics, Inc., Taoyuan (TW)

(72) Inventors: Na Dong, Taoyuan (TW); Yicong Xie, Taoyuan (TW); Min Zhou, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 135 days.

(21) Appl. No.: 15/059,280

(22) Filed: Mar. 2, 2016

(65) Prior Publication Data

US 2016/0314896 A1 Oct. 27, 2016

(30) Foreign Application Priority Data

Apr. 27, 2015 (CN) ..... 2015 1 0204753

(51) Int. Cl.
*H01F 5/00* (2006.01)
*H01F 27/28* (2006.01)
*H01F 21/12* (2006.01)

(52) U.S. Cl.
CPC ..... *H01F 27/2823* (2013.01); *H01F 21/12* (2013.01)

(58) Field of Classification Search
CPC . H01F 5/00; H01F 27/28; H01F 27/29; H01F 27/2823
USPC ..... 336/200, 232
See application file for complete search history.

(56) References Cited

U.S. PATENT DOCUMENTS 4,803,609 A * 2/1989 Gillett ..... H02M 3/28 323/305
6,967,553 B2 * 11/2005 Jitaru ..... G11C 11/15 336/178
2004/0070480 A1 * 4/2004 Nakashima ..... H01F 27/2804 336/200
2009/0295528 A1 * 12/2009 Silva ..... H01F 3/10 336/200
2013/0207767 A1 * 8/2013 Worthington ..... H01F 27/2804 336/84 C

* cited by examiner

*Primary Examiner* — Tsz Chan
(74) *Attorney, Agent, or Firm* — CKC & Partners Co., Ltd.

(57) ABSTRACT

A center-tapped transformer comprises a magnetic core, and windings including a primary winding and a secondary windings. The primary winding comprises at least one layer of a primary effective conductor, and the secondary winding comprises at least one layer of a first secondary effective conductor and at least one layer of a second secondary effective conductor. The total thickness $h_p$ of the primary effective conductor and the total thickness $h_s$ of the secondary effective conductor satisfy: $0.65<h_p/h_s<0.8$, wherein hp is equal to the sum of the thicknesses $d_p$ of all the layers of the primary effective conductor, and $h_s$ is equal to the sum of the thicknesses $d_s$ of all the layers of the first and the second secondary effective conductor.

11 Claims, 8 Drawing Sheets

CENTER-TAPPED TRANSFORMER

CROSS-REFERENCE TO RELATED APPLICATIONS

This non-provisional application claims priority under 35 U.S.C. § 119(a) on Patent Application No. 201510204753.9 filed in P.R. China on Apr. 27, 2015, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present disclosure relates to a transformer, and in particular, to a center-tapped transformer which can achieve a minimum loss in the same window area.

BACKGROUND

In recent years, the miniaturization of switching power supplies has been an important development tendency, but magnetic elements have occupied a fairly large proportion of switching power supplies in terms of volume, weight, loss and cost, etc. Increasing the frequency of switching power supplies is an effective means of reducing the volume of magnetic elements and increasing the power density of switching power supplies, and it is also a hotspot of magnetic design at present. As frequency rises, both a magnetic core loss and a winding loss increase sharply. Thus, decreasing the magnetic core loss and the winding loss is more important for the analysis and design of magnetic devices.

Center-tapped transformer is widely used in power converter with two secondary windings to perform dual half-wave rectification. Different from a non-center tapped transformer, the currents flowing through the two secondary windings of the center-tapped transformer are not synchronous, i.e., the two secondary windings work at a time-sharing mode. An eddy current loss still can be induced in one of the two secondary windings through which current doesn't flow. Due to the particularity of the currents flowing through the two secondary windings in a center-tapped transformer, the analysis of its loss is different from an ordinary non-center tapped transformer.

For a center-tapped transformer, it is a common practice in the prior art that the copper sheet for each layer of the primary and secondary windings has the same thickness. Although it is convenient to design and manufacture such a center-tapped transformer, it is not the best choice in terms of loss and volume.

Refer to FIG. 1A and FIG. 1B. FIG. 1A is an equivalent circuit diagram of an existing center-tapped transformer applied to a LLC circuit, and FIG. 1B is an equivalent circuit diagram of an existing center-tapped transformer applied to a PWM circuit. The dashed boxes in the figures indicate the transformers. P indicates the primary winding of the transformer. S1 and S2 respectively indicate the two secondary windings of the transformer, and the two secondary windings do not work simultaneously. As shown in both FIG. 1A and FIG. 1B, K1 and K2 as well as K3 and K4 (only shown in FIG. 1B) are switching transistors of the primary side of the transformer, D1 and D2 are the switching transistors of secondary side, Co and Cs each indicates capacitance, Ls and Lm each indicates inductor, and Ro indicates output resistor. FIGS. 2A to 2C are the current waveforms of the various windings of the existing center-tapped transformer applied to the LLC circuit, wherein the current waveform of the primary winding in single cycle is a sine-like wave, and the current waveform of each of the two secondary windings in single cycle is a sine-like wave in a half cycle and is 0 in the other half FIGS. 3A to 3C are the current waveforms of the various windings of an existing center-tapped transformer applied to a PWM circuit, wherein the current waveform of the primary winding in single cycle is a positive-negative pulse-like wave, and the current waveform of each of the two secondary windings in single cycle is an pulse-like wave in a half cycle and is 0 in the other half. Thus it can be seen that in both the LLC circuit and the PWM circuit, the current waveforms of the primary winding P in single cycle have a positive part and a negative part. Therefore the fundamental harmonic component of the current in the primary winding P is high, and the DC component and the higher harmonic component are low so that they can be ignored. While currents in the two secondary windings S1 and S2 do not work simultaneously. In single cycle, there is current in only a half cycle while there is no current in the other half Therefore the fundamental harmonic component and the DC component of the currents in the two secondary windings S1 and S2 are high, while the higher harmonic component is low so that it can be ignored, too. Due to the characteristics of harmonic components of the currents flowing through the primary and secondary windings of the center-tapped transformer, how to reasonably set the thicknesses of copper sheets for the primary and secondary windings to distinguish it from a center-tapped transformer in the prior art, in order to make the fullest use of the limited window area, is a problem to be solved by those skilled in the art.

SUMMARY OF THE INVENTION

The present disclosure provides a center-tapped transformer comprises a magnetic core and windings. The windings include a primary winding and secondary windings. The primary winding comprises at least one layer of a primary effective conductor, and the secondary windings comprise at least one layer of a first secondary effective conductor and at least one layer of a second secondary effective conductor. The outer surface of each of the primary effective conductor and the first and second secondary effective conductors is coated with an insulating layer. A transformer window is surrounded by the magnetic core, the height h is the dimension of the transformer window in the stacking direction of the primary winding and the secondary winding. The thickness $d_p$ of a single layer of the primary effective conductor and the thickness $d_s$ of a single layer of the first or second secondary effective conductor are the respective heights of the primary effective conductor and the first or second secondary effective conductor in the stacking direction, wherein the total thickness $h_p$ of the primary effective conductors and the total thickness $h_s$ of the secondary effective conductors satisfy $0.65<h_p/h_s<0.8$, and wherein the total thickness $h_p$ of the primary effective conductors is equal to the sum of the thicknesses $d_p$ of all the layers of the primary effective conductors, and the total thickness $h_s$ of the secondary effective conductors is equal to the sum of the thicknesses $d_s$ of all the layers of the first secondary effective conductors and the second secondary effective conductors.

Hereinafter, the present disclosure is described in detail with reference to the accompanying drawings and embodiments, which, however, are not to limit the present disclosure.

DESCRIPTION OF THE PREFERRED EMBODIMENTS

Hereinafter, the structure principle and the working principle of the present disclosure will be specifically described with reference to the accompanying drawings.

According to the FFT values of the current waveforms of the various windings (namely, the primary winding, the first secondary winding and the second secondary winding) of the center-tapped transformer of the present disclosure, the optimum proportion range of the effective conductor thicknesses of the primary and secondary windings of the center-tapped transformer is determined in consideration of the losses caused by the high-frequency skin effect and the proximity effect, in order to achieve a minimum loss in the same window area. In the prior art, the design that the effective conductors in the primary and secondary windings have the same thickness is often chosen. Although this choice is convenient, the loss is high. Under different working conditions, the proportions of the effective conductor thicknesses of the primary and secondary windings, as determined by the present disclosure, lead to a reduction in the loss of the windings by from about 5% to about 12%, compared with the design that the effective conductors in the primary and secondary windings have the same thickness.

Figure 1A:
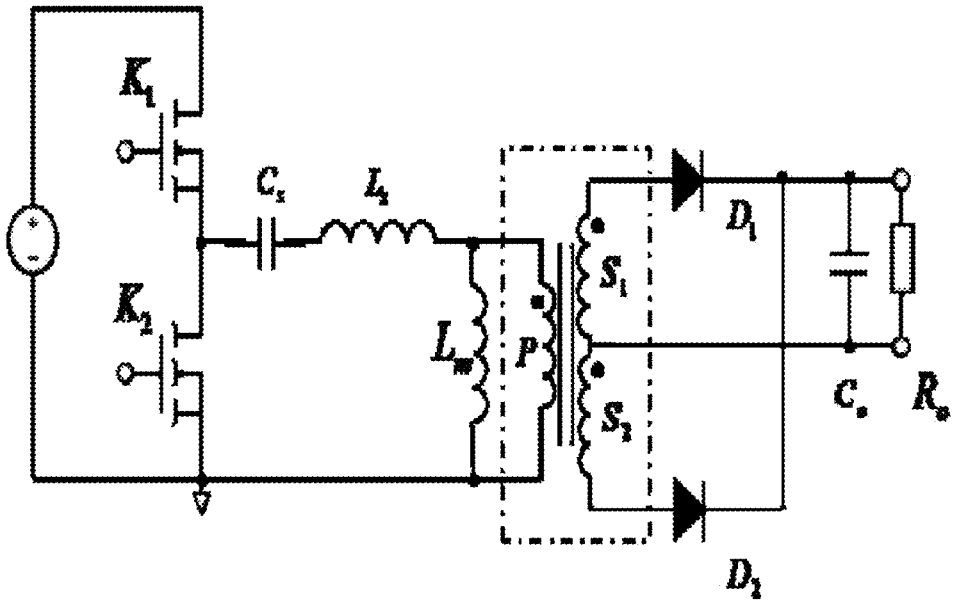
FIG. 1A is an equivalent circuit diagram of a center-tapped transformer applied to a LLC circuit in the prior art.
Figure 1B:
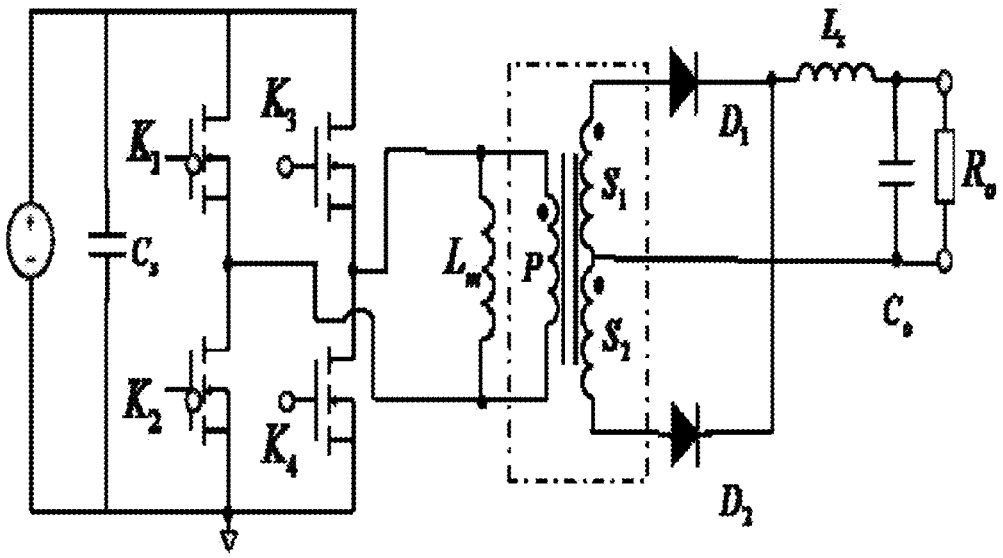
FIG. 1B is an equivalent circuit diagram of a center-tapped transformer applied to a PWM circuit in the prior art.
Figure 2A:
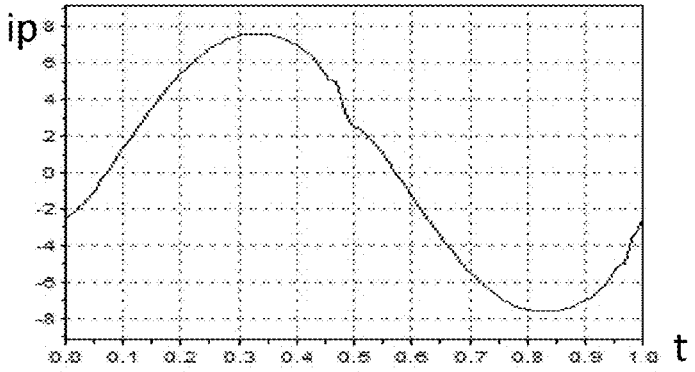
FIGS. 2A to 2C are the current waveforms of the various windings of a center-tapped transformer applied to a LLC circuit in the prior art.
Figure 2B:
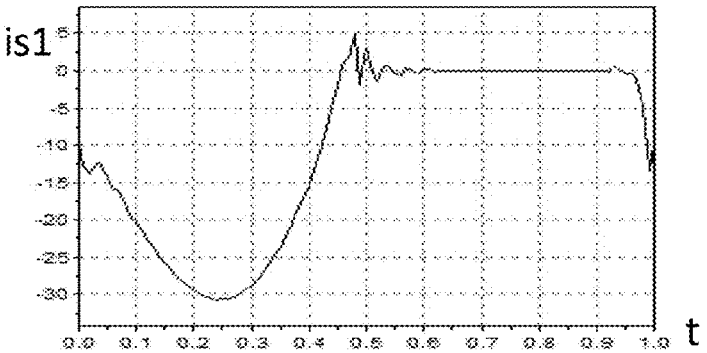
Figure 2C:
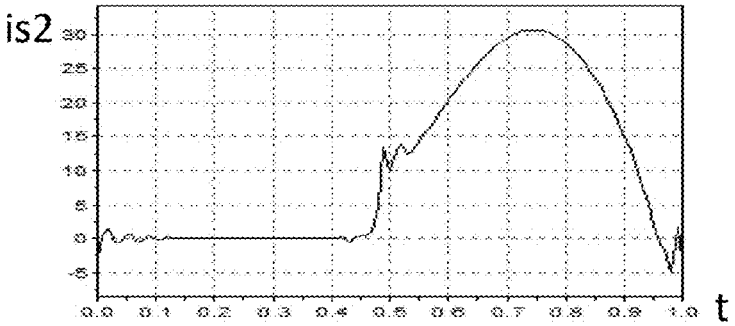
Figure 3A:
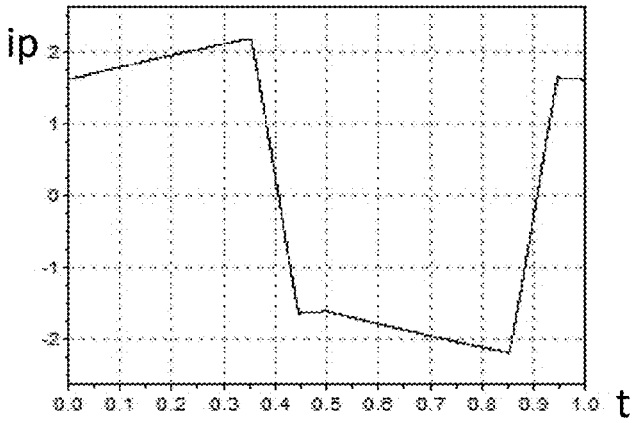
FIGS. 3A to 3C are the current waveforms of the various windings of a center-tapped transformer applied to a PWM circuit in the prior art.
Figure 3B:
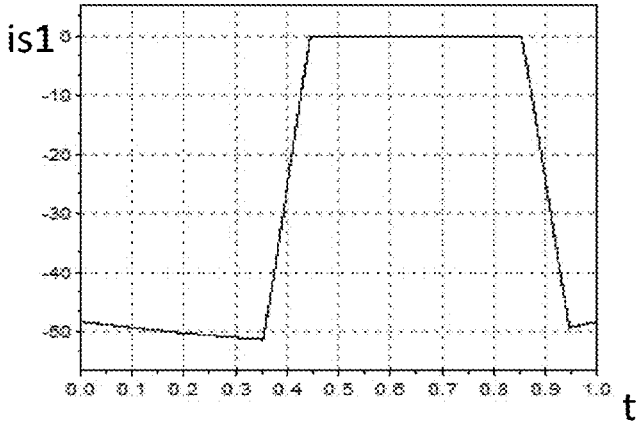
Figure 3C:
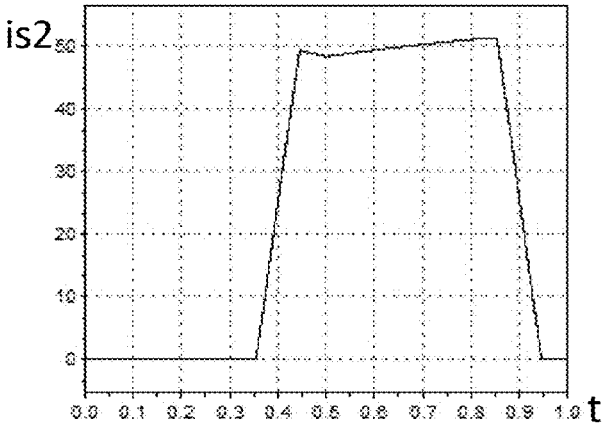
Figure 4:
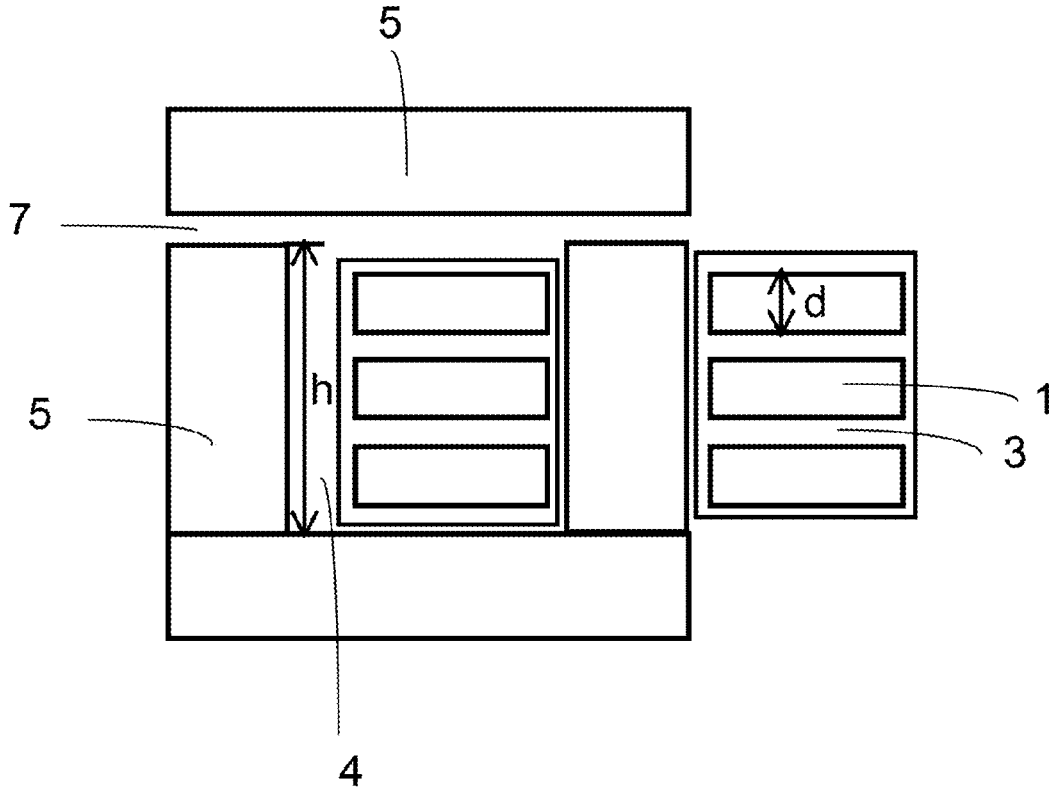
FIG. 4 is a schematic diagram illustrating the window height and the effective conductor thickness of a planar transformer in Example 1.
Figure 5:
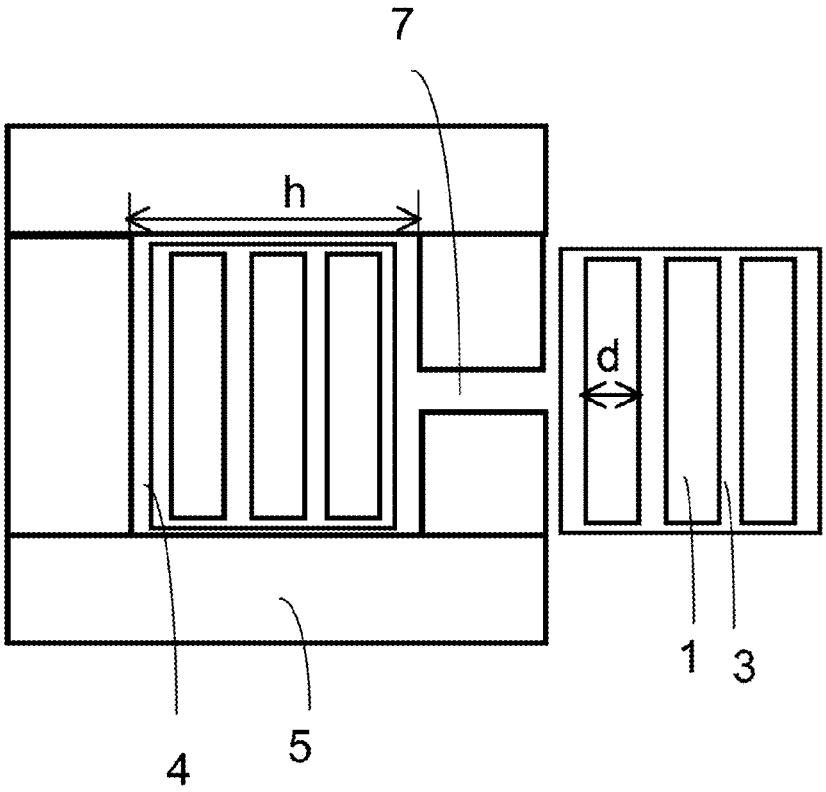
FIG. 5 is a schematic diagram illustrating the window height and the effective conductor thickness of a vertical transformer in Example 1.

Refer to FIG. 4 and FIG. 5, FIG. 4 is a schematic diagram illustrating the window height and the effective conductor thickness of a planar transformer in Example 1, and FIG. 5 is a schematic diagram illustrating the window height and the effective conductor thickness of a vertical transformer in Example 1. The center-tapped transformer of the present disclosure comprises a magnetic core 5 and windings, the windings include a primary winding and secondary windings. The primary winding comprises at least one layer of a primary effective conductor, and the secondary winding comprises at least one layer of a first secondary effective conductor and at least one layer of a second secondary effective conductor. The outer surface of each of the primary effective conductor and the first and second secondary effective conductors is coated with an insulating layer, wherein the effective conductors of the primary effective conductor and the first and second secondary effective conductors are electric conductive or magnetic conductive metals such as copper, silver and aluminum, and the insulating layer is made of an insulating material and plays a part in insulation, pressure tolerance and safety, etc. The magnetic core 5 surrounds a transformer window 4 which has an air gap 7. The height h of the transformer window 4 is the dimension of the transformer window 4 in the stacking direction of the primary winding and the secondary windings. The thickness $d_p$ of a single layer of the primary effective conductor and the thickness $d_s$ of a single layer of the first or second secondary effective conductor are the heights of the primary effective conductor and the first or second secondary effective conductor in the stacking direction respectively, wherein the total thickness $h_p$ of the primary effective conductors and the total thickness $h_s$ of the secondary effective conductors satisfy $0.65<h_p/h_s<0.8$, and wherein the total thickness $h_p$ of the primary effective conductors is equal to the sum of the thicknesses $d_p$ of all the layers of the primary effective conductors, and the total thickness $h_s$ of the secondary effective conductors is equal to the sum of the thicknesses $d_s$ of all the layers of the first secondary effective conductors and the second secondary effective conductors. Since the compositions, structures, relative positional relationships, join relationship and working principles, etc., of the other portions of the transformer are mature, existing technologies, they are not repeated herein. Next, the primary and secondary structures of the present disclosure will be described in detail with reference to the specific examples.

Example 1

Refer to FIGS. 4 and 5, which respectively define the concepts of the thicknesses of the primary and secondary effective conductors 1 of a planar transformer and a vertical transformer. The effective conductors 1 as shown in FIGS. 4 and 5 refer to the portions, in which current really flows, through the windings, and they are called effective conductors of the windings. Common effective conductors are copper, silver, aluminum and other metals. The insulating layer 3 is a nonconductive portion, which covers the outer surfaces of the effective conductors, which does not allow current to pass through, and often plays a part in insulation, pressure tolerance and safety, etc. The height of the window 4 is the dimension of the window 4 in the stacking direction of the primary and secondary windings of the transformer. The symbols h as shown in FIGS. 4 and 5 each stands for the height of the transformer window 4, the thickness of an effective conductor is the height dimension of the effective conductor in the stacking direction of the primary and secondary windings. The symbols d as shown in FIGS. 4 and 5 each stands for the thickness of a single layer of the effective conductor in the transformer.

For a center-tapped transformer, it is defined that the total thickness of the primary effective conductors within the window 4 is $h_p$, the total thickness of the first secondary effective conductors and the second secondary effective conductors is $h_s$, and when $h_p$ and $h_s$ satisfy $0.65<h_p/h_s<0.8$, the loss of the windings in the transformer is within a narrower range.

In an ideal center-tapped transformer, the fundamental harmonic component (denoted as $I_{p1}$, rms) of the current in the primary winding is high, while the amount of DC component and the higher harmonic component is low that they can be ignored; the fundamental harmonic component (denoted as $I_{p1}$, rms) and the DC component (denoted as $I_{sdc}$) of the current in the secondary windings is high, while the higher harmonic component is low that it can be ignored, too. Thus, the losses of the windings in an ideal center-tapped transformer can be divided into the losses of fundamental harmonics of the currents in the primary winding and secondary windings and the DC losses in the secondary windings, wherein the losses of fundamental harmonic components of the currents in the primary and secondary windings are high. In addition, in an ideal center-tapped transformer, the total fundamental harmonic components in the primary and secondary windings are balanced, i.e., the total fundamental harmonic components in the primary winding plus the total fundamental harmonic components in the two secondary windings is equal to 0, that is, $I_{p1}+I_{s1}=0$, and the direction of current flowing through the primary winding $I_{p1}$ is and the direction of current flowing through the first second secondary winding $I_{s1}$ are opposite. As is known to all, when a direct current $I_{dc}$ flows through a winding, there is only a DC, loss and the related computational formula is as follows:

$$\text{Loss}_{dc} = I_{dc}^2 \times R_{dc} = I_{dc}^2 \times \rho \times \frac{l_e}{d \times w} \tag{1}$$

Wherein $R_{dc}$ stands for DC resistance, ρ stands for the resistivity of the winding, $l_e$ stands for the length of the winding, d stands for the thickness of the effective conductor in the winding, and w stands for the width of the effective conductor in the winding. Thus it can be seen that under the circumstance that the other conditions are definite, the thicker the effective conductor, the smaller the DC loss. If a high frequency AC $I_{HF}$ flows through the winding, the resistance of the winding will increase as a result of the phenomena unique to high frequencies, e.g., the skin effect, the proximity effect and the effect of the air gap 7, and the situation will become very complicated. To make it simple, like the DC loss, the loss of the high frequency winding is generally represented by the following formula:

$$\text{Loss}_{HF}=I_{HF}^2\times R_{dc}\times K_{ac} \tag{2}$$

Wherein $K_{ac}$ stands for AC coefficient, which characterizes the ratio of high-frequency resistance to DC resistance. In general, the thicker the effective conductor, the smaller the DC loss and the greater $K_{ac}$. However, by and large, the loss of the high frequency winding tends to be reduced with the increasing thickness of the effective conductor. If an appropriate structure is selected, the $K_{ac}$ of the ideal transformer will be lower, for example, approximately in the range of from 1.1 to 2.0. In this case, in consideration of the fundamental harmonic components of the currents in the primary and secondary windings and the amount of DC components in the secondary windings, the total loss of the transformer is represented by the following formula:

$$\text{Loss}=I_{p1}^2\times R_p\times K_P+I_{s1}^2\times R_s\times K_s+I_{s1}^2\times T^2\times R_s \tag{3}$$

Wherein $R_p$ and $R_s$ stand for the DC resistances of the primary and secondary windings, respectively, and $K_p$ and $K_s$ stand for the alternating current coefficients (AC coefficients) of the primary and secondary windings, respectively. According to different working conditions, the ratios T standing for the DC components of the currents in the secondary windings to the fundamental harmonic components of the currents in the secondary windings are different. Typically, this ratio is from about 0.5 to about 0.9. Moreover, because of $$I_{p1}=-I_{s1} \tag{4},$$

$$\text{Loss}=I_{s1}^2\times R_p\times K_p+I_{s1}^2\times R_s\times K_s+I_{s1}^2\times T^2\times R_s \tag{5}.$$

Under the total thickness of effective conductors is definite, in order to achieve a relatively small overall loss of the windings, it is appropriate to make the loss of the primary winding substantially equivalent to the loss of the secondary windings, i.e., $$R_p\times K_p=R_s\times K_s+T^2\times R_s \tag{6}$$

If $K_P=K_s=1.5$, when T=0.5, $R_s/R_p$ shall be 0.86, and then the ratio $n_p/n_s$ of the primary effective conductor thickness to the secondary effective conductor thickness is 0.86; similarly, if T=0.9, $n_p/n_s$ shall be 0.65. Thus it can be seen that the greater T is, i.e., the higher proportion the DC components of the currents in the secondary windings account for, the higher proportion the thicknesses of the secondary effective conductors will account for.

The above inference is based on the assumption that all the AC coefficients of the primary and secondary windings are 1.5, and the conclusion thus drawn is that the ratio of the primary effective conductor thickness to the secondary effective conductor thickness should satisfy $0.65<h_p/h_s<0.86$. As previously described, the thicker the effective conductor, the greater the AC coefficient. That is to say, $K_{ac}$ might be greater than or less than 1.5. Furthermore, it can be given that the thicknesses of the primary and secondary effective conductors may be different, the AC coefficients, i.e. $K_p$ and $K_s$, of the primary and secondary windings should not be exactly the same. In consideration of the actual range of $K_{ac}$ of from 1.1 to 2.0, based on a large amount of simulation data and calculating data in combination with the current waveforms of the various windings of a center-tapped transformer under different working conditions, it has been finally determined that the ratio of the total thickness of the primary effective conductors to the total thickness of the secondary effective conductors is in the range of $0.65<h_p/h_s<0.8$. The total loss of the windings is relatively small, and the loss can be reduced by from about 5% to about 12%, compared with the thickness of copper sheets in the prior art, i.e., the total thickness of the primary effective conductors is equal to the total thickness of the secondary effective conductors. In particular, the effect is especially obvious when the operating frequency of the circuit is between 500 k and 2 MHz.

As for a center-tapped transformer applied to a resonant circuit, e.g., a center-tapped transformer applied to a LLC circuit, there should be $0.7<h_p/h_s<0.8$. Regarding the center-tapped transformer, the ratio of the DC components of currents in the secondary windings to the fundamental harmonic components of currents in the secondary windings is about 0.6, and this ratio varies slightly under different working conditions.

As for a center-tapped transformer applied to a PWM circuit, there should be $0.65<h_p/h_s<0.75$. Regarding the center-tapped transformer, the ratio of the DC components of the currents in the secondary windings to the fundamental harmonic components of the currents in the secondary windings is about 0.9, and this ratio varies slightly under different working conditions. Compared with the center-tapped transformer applied to a LLC circuit, the DC components of the currents in the secondary windings of the center-tapped transformer applied to a PWM circuit accounts for a higher proportion, thus the thicknesses of the secondary effective conductors of the center-tapped transformer applied to a PWM circuit account for a higher proportion than the thicknesses of the secondary effective conductors of the center-tapped transformer applied to a LLC circuit.

Example 2

Figure 6:
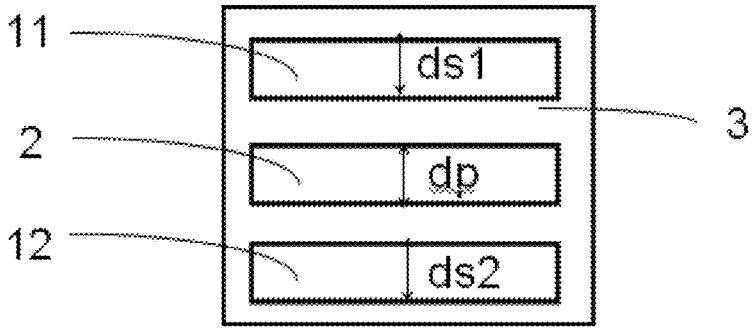
FIG. 6 is a schematic diagram illustrating the structure of the winding with SPS as the basic unit in Example 2.

A center-tapped transformer often has windings with S1 P S2 as the winding unit, so that the transformer has the winding which has a 3n layer structure being stacked up by n winding unit, wherein n is a natural number. The winding has 3n layers of effective conductors. The peer to peer secondary windings S1 and S2 in the winding unit may be interchanged, i.e., stacking can be performed by using S2 P S1 as the winding unit. In order to make S1 and S2 in the circuit be symmetrical as much as possible, the thicknesses of the effective conductors in the secondary windings S1 and S2 should be equal in principle, without considering problems such as tolerance existed in the production process. Referring to FIG. 6 which shows a winding unit of S1 P S2, the secondary winding comprises a first secondary winding S1, and a second secondary winding S2, each said winding having S1PS2 as a winding unit so that the winding has a structure formed from 3n layers that are stacked up, wherein S1 is the first secondary winding, P is the primary winding, S2 is the second secondary winding, n is a natural number, and if $1.4<d_p/d_{s1}<1.6$ or $1.4<d_p/d_{s2}<1.6$, then $0.7<h_p/h_s<0.8$, and wherein $d_p$ stands for the thickness of the primary effective conductor 2, $d_{s1}$ stands for the thickness of the first secondary effective conductor 11, $d_{s2}$ stands for the thickness of the second secondary effective conductor 12, and $d_{s1}=d_{s2}$, $h_p=n*d_p$, $h_s=2*n*d_{s1}$ or $h_s=2*n*d_{s2}$. In other words, in the case of a center-tapped transformer applied to a LLC circuit, in each winding unit S1 P S2, the thickness $d_p$ of a single layer of the primary effective conductor 2 and the thickness $d_{s1}$ of a single layer of the first secondary effective conductor (or the thickness $d_{s2}$ of a single layer of the second secondary effective conductor) satisfy $1.4<d_p/d_{s1}(d_{s2})<1.6$, then the total thickness of the primary effective conductors $h_p=n*d_p$ and the total thickness of the secondary effective conductors $h_s=2*n*d_{s1}$ $(d_{s2})$, which also satisfy $0.7<h_p/h_s<0.8$ as in Example 1. In the case of a center-tapped transformer applied to a PWM circuit, there is $1.3<d_p/d_{s1}(d_{s2})<1.5$, then the total thickness $h_p$ of the primary effective conductors 2 and the total thickness 11, of the secondary effective conductors also satisfy $0.65<h_p/h_s<0.75$ as in Example 1. In other examples, the center-tapped transformer has a three-layer structure formed from the stacking S1 P S2, wherein the primary effective conductor, the first secondary effective conductor and the second secondary effective conductor can each be a layer. If $1.4<d_p/d_{s1}<1.6$ or $1.4<d_p/d_{s2}<1.6$, then $0.7<h_p/h_s<0.8$, wherein $d_p$ stands for the thickness of the primary effective conductor 2, $d_{s1}$ stands for the thickness of the first secondary effective conductor 11, $d_{s2}$ stands for the thickness of the second secondary effective conductor 12, and $d_{s1}=d_{s2}$, $h_p=d_p$, $h_s=2*d_{s1}$ or $h_s=2*d_{s2}$.

Example 3

Figure 7A:
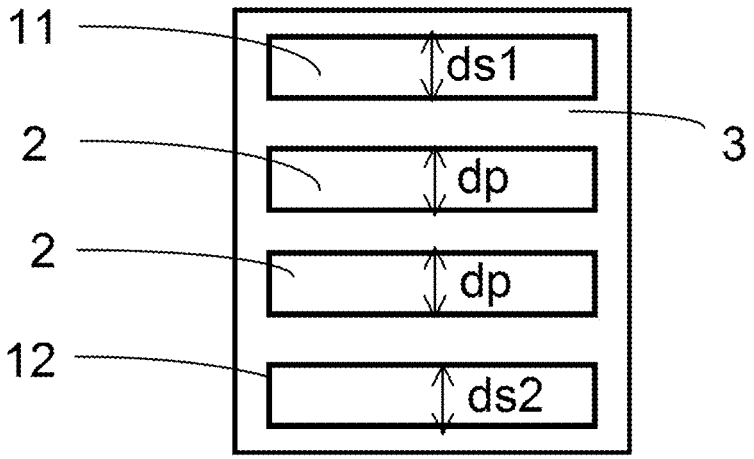
FIG. 7A is a schematic diagram illustrating the structure of the winding with SPPS as the basic unit in Example 3.
Figure 7B:
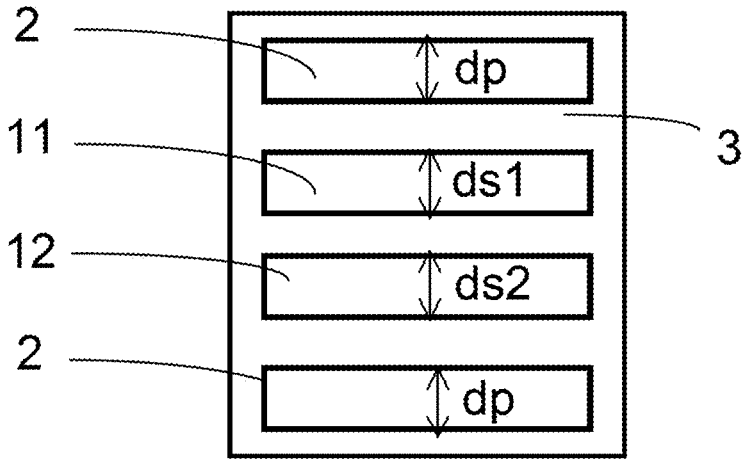
FIG. 7B is a schematic diagram illustrating the structure of the winding with PSSP as the basic unit in Example 3.

Refer to FIGS. 7A and 7B, wherein FIG. 7A shows a winding unit of S1 PP S2, and FIG. 7B shows a basic unit of P S1 S2 P. A center-tapped transformer also often has windings with S1 P P S2 (or P S1 S2 P) as the winding unit, so that the transformer has the winding which has a 4n layer structure being stacked up by n winding unit. The winding has 4n layers of effective conductors, wherein n is a natural number, the peer to peer secondary windings S1 and S2 in the basic unit may be interchanged, i.e., stacking can be performed by using S2 P P S1 (or P S2 S1 P) as the winding unit. In order to make the secondary windings S1 and S2 symmetrical as much as possible, the thicknesses of the effective conductors in the secondary windings S1 and S2 should be equal in principle, without considering problems such as the tolerance in the production process. The secondary winding comprises a first secondary winding and a second secondary winding, each said winding having S1PPS2 or PS1S2P as a winding unit so that the winding has a structure formed from 4n layers that are stacked up, wherein S1 is the first secondary winding, P is the primary winding, S2 is the second secondary winding, n is a natural number, and if $0.7<d_p/d_s<0.8$, then $0.7<h_p/h_s<0.8$, and wherein $d_p$ stands for the thickness of a single layer of the primary effective conductor 2, $d_{s1}$ stands for the thickness of a single layer of a single layer of the first secondary effective conductor 11, $d_{s2}$ stands for the thickness of a single layer of the second secondary effective conductor 12, and $d_{s1}=d_{s2}$, $h_p=2*n*d_p$, $h_s=2*n*d_{s1}$ or $h_s=2*n*d_{s2}$. In other words, in the case of a center-tapped transformer applied to a LLC circuit, in each basic unit S1 P P S2, the thickness $d_p$ of the primary effective conductor 2 and the total thickness $d_{s1}$ (or $d_{s2}$) of the secondary effective conductor satisfy $0.7<d_p/2*d_{s1}<0.8$ or $0.7<d_p/2*d_{s2}<0.8$, then the total thickness of the primary effective conductors 2 $h_p=2*n*d_p$ and the total thickness of the secondary effective conductors $h_s=2*n*d_{s1}$ or $2*n*d_{s2}$, which also satisfy $0.7<h_p/h_s<0.8$ as in Example 1. In the case of a center-tapped transformer applied to a PWM circuit, there is $0.65<d_p/2*d_{s1}<0.75$ or $0.6<d_p/2*d_{s2}<0.75$, then the total thickness $h_p$ of the primary effective conductors 2 and the total thickness $h_s$ of the secondary effective conductors also satisfy $0.65<h_p/h_s<0.75$ as in Example 1.

Example 4

Figure 8:
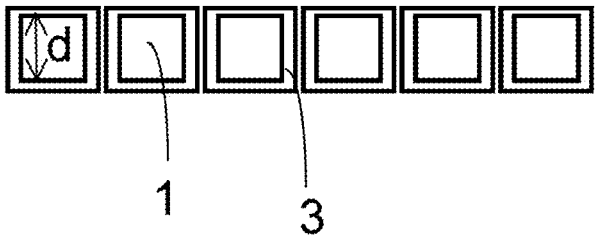
FIG. 8 is a schematic diagram illustrating the winding in Example 4.

Refer to FIG. 8, which shows the winding in Example 4. Among at least one layer of the primary effective conductor, at least one layer of the first secondary effective conductor and at least one layer of the second secondary effective conductor, at least one includes more than two conductors, and the outer surface of each of the primary effective conductor and the first and second secondary effective conductors is coated with an insulating layer. The conductor has a rectangular cross section. It should be noted that, for example, the winding in Example 2 has a 3n-layer structure of S1 P S2, then the primary winding P includes layers of primary effective conductors, the secondary windings S1 and S2 include a layer of the first secondary effective conductive and a layer of the second secondary effective conductor, and at least one of the primary effective conductor, the first secondary effective conductor and the second secondary effective conductor includes more than two conductors; alternatively, the secondary winding S1 includes layers of the first secondary effective conductors, the primary winding includes a layer of the primary effective conductor, the secondary winding S2 includes a layer of the second secondary effective conductor, and at least one of the at least one layer of the first secondary effective conductor, the primary effective conductor and the second secondary effective conductor includes more than two conductors; alternatively, the secondary winding S2 includes layers of the second secondary effective conductors, the primary winding includes a layer of the primary effective conductor, the secondary winding S1 includes a layer of the first secondary effective conductor, and at least one of the at least one layer of the second secondary effective conductor, the primary effective conductor and the first secondary effective conductor includes more than two conductors; alternatively, the primary winding includes layers of the primary effective conductors, and the secondary windings S1 and S2 include layers of the first secondary effective conductors and layers of the second secondary effective conductors, respectively, and at least one of the at least one layer of the first secondary effective conductor, the at least one layer of the primary effective conductor and the at least one layer of the second secondary effective conductor includes more than two conductors. In this example, the thicknesses d of the primary effective conductor and the first and second secondary effective conductors are also the heights of the primary effective conductor and the first and second secondary effective conductors in the stacking direction of the primary and secondary windings. The total thickness of the primary and secondary effective conductors in a transformer of such a shape also meets the requirements in Example 1.

Example 5

Figure 9:
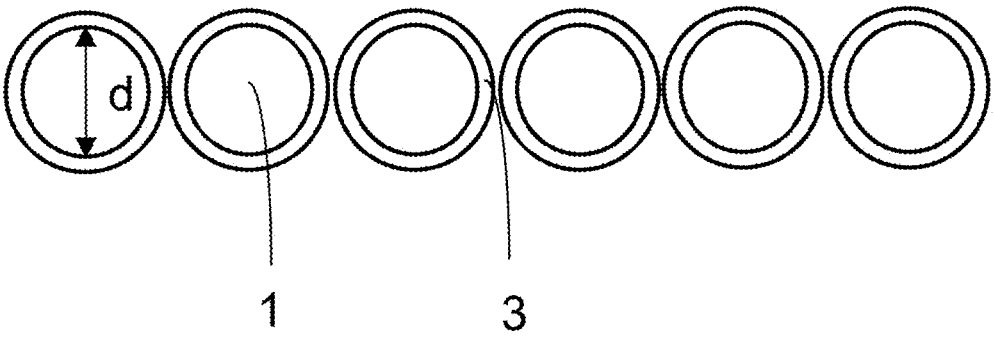
FIG. 9 is a schematic diagram illustrating the winding in Example 5.

Refer to FIG. 9, which shows the winding in Example 5. As shown in FIG. 9, among at least one layer of the primary effective conductor, at least one layer of the first secondary effective conductor and at least one layer of the second secondary effective conductor, at least one includes more than two conductors, and the outer surface of each of the primary effective conductor and the first and second secondary effective conductors is coated with an insulating layer. The conductor has a circular or oval cross section, wherein the conductor can be circular wire or a Litz wire, i.e., a single layer of an effective conductor consisting of a plurality of circular or Litz wires comprises a plurality of conductors. In this example, the thicknesses d of the primary effective conductor and the first and second secondary effective conductors are also the heights of the primary effective conductor and the first and second secondary effective conductors in the stacking direction of the primary and secondary windings. The total thickness of the primary and secondary effective conductors in a transformer of such a shape also meets the requirements in Example 1.

Figure 10:
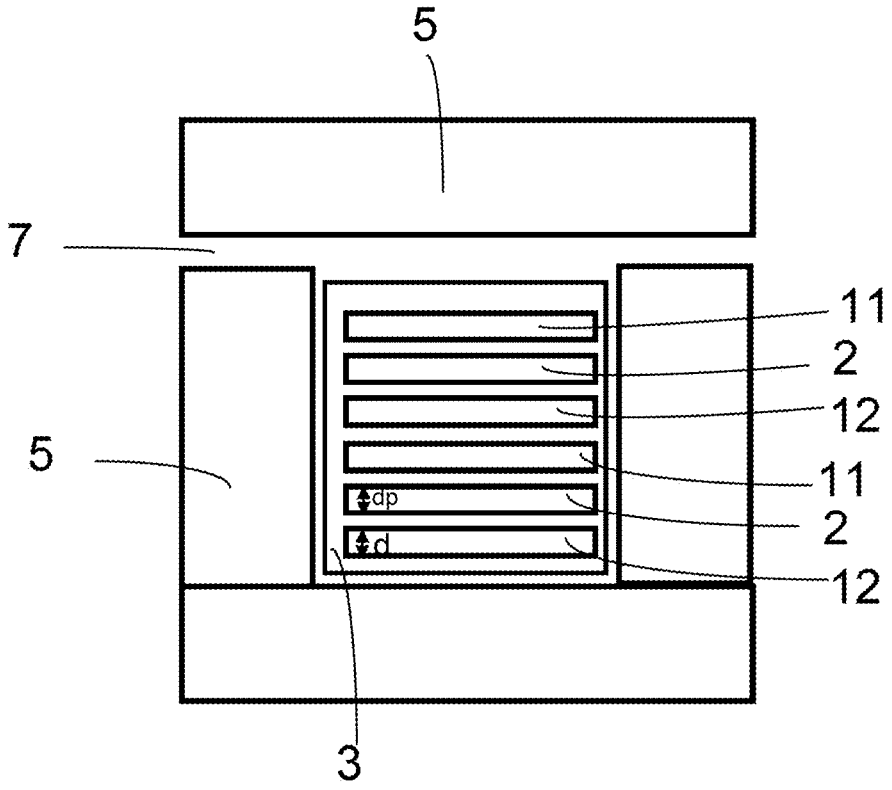
FIG. 10 is a schematic diagram illustrating a transformer having a total of 6 layers of copper sheets, wherein the winding has SPS as the basic unit.

Refer to FIG. 10, which is a schematic diagram illustrating a transformer which has the winding having a 6 layers structure, wherein the winding has SPS as the winding unit. The transformer as shown in FIG. 10 consists of the stacking winding units of SPS. In the figure, $d_p$ and $d_s$ stand for the thickness of a single layer of the primary effective conductor 2 and the thickness of a single layer of the first secondary effective conductor 11 or a single layer of the second secondary effective conductor 12, respectively. If the transformer works in a circuit with a resonant frequency of 1 MHz, and the FFT values of the currents in the primary winding and the first secondary winding, i.e., S1, are shown in the table below (the current in the second secondary winding, i.e., S2, is the same as the current in the first secondary winding, i.e., S1, so it is not listed in the table):

| | DC component | Valid value of fundamental harmonic component |
|---|---|---|
| Primary current (A) | 0 | 8 |
| First secondary current (A) | 2 | 4 |

In this example, the primary effective conductor and the first and second secondary effective conductors are copper sheets. Suppose the copper sheets have a width of 4 mm, the insulating layer 3 between the copper sheets has a thickness of 0.1 mm, the total thickness of the copper sheets is 0.5 mm, and the working temperature is 25° C. If the total thickness of copper sheets of the primary winding in the transformer is equal to the total thickness of copper sheets of the secondary windings, the thickness of each of the copper sheets is 0.083 mm. When the copper sheet of the winding is 1 meter long, the total loss of the windings in the transformer, through simulation and calculation, is 2.9 W; if the ratio of the thickness $d_p$ of a single layer of copper sheet 2 of the primary winding in the transformer to the thickness $d_s$ of a single layer of copper sheet of the first secondary winding is 1.6, i.e., the thickness of a single layer of copper sheet of the primary winding 2 is 0.11 mm, the thickness of a single layer of copper sheet of the first secondary winding is 0.069 mm and the copper sheet of the winding is 1 meter long, too, then the loss will be 2.6 W, that is, reduced by 11.5%. The above are listed below:

| | $d_p = d_s$ | $d_p/d_s = 1.6$ |
|---|---|---|
| Thickness of a single layer of copper sheet of the primary | 0.083 mm | 0.11 mm |
| Thickness of a single layer of copper sheet of the first secondary | 0.083 mm | 0.069 mm |
| Total loss of windings | 2.9 W | 2.6 W |

Thus it can be seen that, according to the FFT values of the current waveforms of the various windings of the center-tapped transformer of the present disclosure, the optimum proportion range of the effective conductor thicknesses of the primary and secondary windings of the center-tapped transformer is determined in consideration of the losses caused by the high-frequency skin effect and the proximity effect, in order to achieve a minimum loss in the same area of the window 4. Under different working conditions, the proportions of the thicknesses of copper sheets of the primary and secondary in the present disclosure reduce the loss of the windings by from about 5% to about 12%, compared with the structure in the prior art that all copper sheets the primary and secondary are of the same thickness.

Of course, the present disclosure may have a variety of other embodiments. Those skilled in the art can make all kinds of corresponding changes and modifications according to the present disclosure without departing from the spirit and essence of the present disclosure. It is intended that all these changes and modifications be covered by the appended claims of the present disclosure.

What is claimed is:

1. A center-tapped transformer comprises a magnetic core and windings, the windings including a primary winding and secondary windings, wherein the primary winding comprising at least one layer of a primary effective conductor, the secondary windings comprising at least one layer of a first secondary effective conductor and at least one layer of a second secondary effective conductor, the outer surface of each of the primary effective conductor and the first and second secondary effective conductors being coated with an insulating layer, a transformer window being surrounded by the magnetic core, the height h is the dimension of the transformer window in the stacking direction of the primary winding and the secondary windings, the thickness $d_p$ of a single layer of the primary effective conductor and the thickness $d_s$ of a single layer of the first or second secondary effective conductor being the respective heights of the primary effective conductor and the first or second secondary effective conductor in the stacking direction, wherein the total thickness $h_p$ of the primary effective conductors and the total thickness $h_s$ of the secondary effective conductors satisfy $0.65<h_p/h_s<0.8$, and the total thickness $h_p$ of the primary effective conductors is equal to the sum of the thicknesses $d_p$ of all the layers of the primary effective conductors, and the total thickness $h_s$ of the secondary effective conductors is equal to the sum of the thicknesses $d_s$ of all the layers of the first secondary effective conductors and the second secondary effective conductors.

2. The center-tapped transformer according to claim 1, wherein the transformer is applied to a LLC circuit, and the total thickness $h_p$ of the primary effective conductors and the total thickness $h_s$ of the secondary effective conductors satisfy: $0.7<h_p/h_s<0.8$.

3. The center-tapped transformer according to claim 2, wherein the secondary windings comprise a first secondary winding and a second secondary winding, each said winding is formed by a winding unit in the form of S1PS2 so that the winding has a structure formed from 3n layers that are stacked up, wherein S1 is the first secondary winding, P is the primary winding, S2 is the second secondary winding, n is a natural number, and if $1.4<d_p/d_{s1}<1.6$ or $1.4<d_p/d_{s2}<1.6$, then $0.7<h_p/h_s<0.8$, and wherein $d_p$ stands for the thickness of each layer of the primary effective conductor, $d_{s1}$ stands for the thickness of each layer of the first secondary effective conductor, $d_{s2}$ stands for the thickness of each layer of the second secondary effective conductor, and $d_{s1}=d_{s2}$, $h_p=n*d_p$, $h_s=2*n*d_{s1}$ or $h_s=2*n*d_{s2}$.

4. The center-tapped transformer according to claim 2, wherein the secondary windings comprise a first secondary winding and a second secondary winding, each said winding is formed by a winding unit in the form of S1PPS2 or PS1S2P so that the winding has a structure formed from 4n layers that are stacked up, wherein S1 is the first secondary winding, P is the primary winding, S2 is the second secondary winding, n is a natural number, and if $0.7<d_p/d_s<0.8$, then $0.7<h_p/h_s<0.8$, and wherein $d_p$ stands for the thickness of each layer of the primary effective conductor, $d_{s1}$ stands for the thickness of each layer of the first secondary effective conductor, $d_{s2}$ stands for the thickness of each layer of the second secondary effective conductor, and $d_{s1}=d_{s2}$, $h_p=2*n*d_p$, $h_s=2*n*d_{s1}$ or $h_s=2*n*d_{s2}$.

5. The center-tapped transformer according to claim 1, wherein the transformer is applied to a PWM circuit, and the total thickness $h_p$ of the primary effective conductors and the total thickness $h_s$ of the secondary effective conductors satisfy: $0.65<h_p/h_s<0.75$.

6. The center-tapped transformer according to claim 5, wherein the secondary windings comprises a first secondary winding and a second secondary winding, each said winding is formed by a winding unit in the form of S1PS2 so that the winding has a structure formed from 3n layers that are stacked up, wherein S1 is the first secondary winding, P is the primary winding, S2 is the second secondary winding, n is a natural number, and if $1.3<d_p/d_{s1}<1.5$ or $1.3<d_p/d_{s2}<1.5$, then $0.65<h_p/h_s<0.75$, and wherein $d_p$ stands for the thickness of each layer of the primary effective conductor, $d_{s1}$ stands for the thickness of each layer of the first secondary effective conductor, $d_{s2}$ stands for the thickness of each layer of the second secondary effective conductor, and $d_{s1}=d_{s2}$, $h_p=n*d_p$, $h_s=2*n*d_{s1}$ or $h_s=2*n*d_{s2}$.

7. The center-tapped transformer according to claim 5, wherein the secondary windings comprises a first secondary winding and a second secondary winding, each said winding is formed by a winding unit in the form of S1PPS2 or PS1S2P so that the winding has a structure formed from 4n layers that are stacked up, wherein S1 is the first secondary winding, P is the primary winding, S2 is the second secondary winding, n is a natural number, and if $0.65<d_p/d_s<0.75$, then $0.65<h_p/h_s<0.75$, and wherein $d_p$ stands for the thickness of each layer of the primary effective conductor, $d_{s1}$ stands for the thickness of each layer of the first secondary effective conductor, $d_{s2}$ stands for the thickness of each layer of the second secondary effective conductor, and $d_{s1}=d_{s2}$, $h_p=2*n*d_p$, $h_s=2*n*d_{s1}$ or $h_s=2*n*d_{s2}$.

8. The center-tapped transformer according to claim 1, wherein the winding comprises a winding unit, which comprises the primary winding and the secondary windings that are arranged sequentially.

9. The center-tapped transformer according to claim 1, wherein the at least one layer of the primary effective conductor comprises more than two conductors, and the outer surface of the primary effective conductor is coated with the insulating layer.

10. The center-tapped transformer according to claim 1, wherein the at least one layer of the first secondary effective conductor or the second secondary effective conductor comprises more than two conductors, and the outer surface of the first secondary effective conductor or the second secondary effective conductor is coated with the insulating layer.

11. The center-tapped transformer according to claim 1, wherein at least one of the primary effective conductor, the first secondary effective conductor and the second secondary effective conductor has a circular, oval or rectangular cross section.

* * * * *